US011097290B2

(12) United States Patent
Wu et al.

(10) Patent No.: US 11,097,290 B2
(45) Date of Patent: Aug. 24, 2021

(54) WATER OUTFLOW DEVICE

(71) Applicant: Xiamen Solex High-Tech Industries Co., Ltd., Xiamen (CN)

(72) Inventors: Shilong Wu, Xiamen (CN); Wenxing Chen, Xiamen (CN); Fengde Lin, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 70 days.

(21) Appl. No.: 16/572,877

(22) Filed: Sep. 17, 2019

(65) Prior Publication Data

US 2020/0086335 A1 Mar. 19, 2020

(30) Foreign Application Priority Data

Sep. 17, 2018 (CN) ..... 201811082146.X

(51) Int. Cl.
*B05B 1/18* (2006.01)
*B05B 3/04* (2006.01)
(Continued)

(52) U.S. Cl.
CPC ..... *B05B 1/185* (2013.01); *B05B 1/12* (2013.01); *B05B 1/18* (2013.01); *B05B 1/3006* (2013.01); *B05B 3/04* (2013.01); *B05B 3/0418* (2013.01)

(58) Field of Classification Search
CPC .... B05B 1/12; B05B 1/16; B05B 1/18; B05B 1/185; B05B 1/3006; B05B 1/3046;
(Continued)

(56) References Cited

U.S. PATENT DOCUMENTS 1,982,538 A * 11/1934 Reedy ..... B05B 15/5225 239/117
4,018,385 A * 4/1977 Bruno ..... B05B 1/083 239/381
(Continued)

FOREIGN PATENT DOCUMENTS

CN 203935930 U * 11/2014 ..... B05B 15/5225
CN 105944851 A * 9/2016 ..... B05B 1/18
CN 106061618 A 10/2016

OTHER PUBLICATIONS

Translation of CN-105944851-A, Jan. 12, 2021, ProQuest LLC, 16 pages (Year: 2021).*
(Continued)

*Primary Examiner* — Chee-Chong Lee
*Assistant Examiner* — Kevin Edward Schwartz
(74) *Attorney, Agent, or Firm* — Cooper Legal Group, LLC

(57) ABSTRACT

The disclosure discloses a water outflow device, which comprises a shell, a movable plate and a driving mechanism. The shell is provided with a water outflow part comprising a water outlet, the water outlet comprises a first inner sidewall, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate has at least one insertion part fixedly disposed on the movable plate, and the insertion part is at least partially inserted into the water outlet.

15 Claims, 11 Drawing Sheets

(51) Int. Cl.
*B05B 1/30* (2006.01)
*B05B 1/12* (2006.01)

(58) Field of Classification Search
CPC ..... B05B 1/3426; B05B 1/3468; B05B 3/04; B05B 3/008; B05B 3/0463; B05B 3/0486; B05B 1/22; B05B 1/30; B05B 1/34; B05B 3/0418; B05B 15/52; B05B 15/522; B05B 15/5223; B05B 15/5225; E03C 1/0408
USPC ..... 239/381, 382, 383, 444, 525, 562, 589
See application file for complete search history.

(56) References Cited

U.S. PATENT DOCUMENTS 7,770,820 B2 * 8/2010 Clearman ..... B05B 3/16 239/222.11
9,839,923 B2 * 12/2017 Ramos De Barros ..... B05B 15/525

OTHER PUBLICATIONS

Translation of CN-203935930-U Jan. 12, 2021, ProQuest LLC, 16 pages (Year: 2021).*

* cited by examiner

B-B

WATER OUTFLOW DEVICE

RELATED APPLICATIONS

This application claims priority to Chinese Patent Application 201811082146.x, filed on Sep. 17, 2018, which is incorporated herein by reference.

FIELD OF THE DISCLOSURE

The present disclosure relates to the field of bathroom fixtures, in particular to a water outflow device.

BACKGROUND OF THE DISCLOSURE

Existing water outflow devices, such as the shower with turbine-driven shutters disclosed in CN106061618A, include embodiments of a shower. In some of the embodiments, the shower comprises a shell, and the shell is disposed with a chamber, a first row of nozzles and a second row of nozzles, which respectively are in fluid communication with a fluid inlet (e.g., water sources). The shower further comprises at least one massage component, which is at least partially disposed in the chamber. Each one of the at least one massage component comprises at least one turbine, at least one cam connected to or integrated with the at least one turbine, and at least one shutter connected to the at least one cam. As for the structure of the at least one of massage component, a movement of the at least one shutter is limited along a single axis, so that when the at least one turbine rotates, the cam causes the at least one shutter to move so that the first row of nozzles and the second row of nozzles alternately connect or disconnect with the fluid inlet. The first row of nozzles and the second row of nozzles are respectively provided with different water outflow spray patterns or water outflow spray angles. As such, if there is need for the water outflow device to have different water outflow spray patterns or water outflow spray angles, different nozzles need to be included.

BRIEF SUMMARY OF THE DISCLOSURE

In order to solve the aforementioned problems in the existing techniques, the disclosure provides a water outflow device.

One of the technical schemes provided by the disclosure is as follows:

A water outflow device, comprises a shell, a movable plate and a driving mechanism. The shell comprises a water outflow part, the water outflow part comprises at least one water outlet, and each of the at least one water outlet comprises a first inner sidewall. The driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, each of the at least one insertion part is provided with a first outer sidewall, and each of the at least one insertion part is at least partially inserted into a corresponding one of the at least one water outlet. When the movable plate is located in the first position, a first water outflow passage is formed in each of the at least one water outlet between the first outer sidewall of a corresponding one of the at least one inspection part and the first inner sidewall, and when the movable plate is located in a second position, a second water outflow passage is formed in each of the at least one water outlet. Each of the second water outflow passages comprises a rear water outflow passage formed between the first outer sidewall of the corresponding one of the at least one insertion part and the first inner sidewall, and a front water outflow passage formed by the lower port of the water outlet. Each of the front water outflow passages is connected to each of the rear water outflow passages.

In a preferred embodiment, each of the at least one water outlet comprises a first inner side wall and a second inner sidewall, the second inner sidewall of each of the at least one water outlet faces the first inner sidewall of each of the at least one water outlet, the first inner sidewall and the second inner sidewall cooperate to form a trapezoidal structure with a lower end (a front end) that is narrower than an upper end (a rear end), each of the at least one insertion part comprises a second outer sidewall, the second outer sidewall of each of the at least one insertion part faces away from the first outer sidewall of each of the at least one insertion part, and the first outer sidewall and the second outer sidewall cooperate to form a trapezoidal structure with a lower end that is narrower than an upper end.

In a preferred embodiment, the first outer sidewall and the first inner sidewall are arranged in parallel at intervals.

In a preferred embodiment, the first outer sidewall and the first inner sidewall are arranged in parallel at intervals, and an inclination angle of the second outer sidewall relative to the moving direction of the movable plate is the same as an inclination angle of the second inner sidewall relative to the moving direction of the movable plate.

In a preferred embodiment, the trapezoidal structure formed by cooperation of each of the at least one first inner sidewall and each of the at least one second inner sidewall is a symmetrical trapezoidal structure, and the trapezoidal structure formed by cooperation of each of the at least one first outer sidewall and each of the at least one second outer sidewall is a symmetrical trapezoidal structure.

In a preferred embodiment, an inclination angle of each of the at least one first inner sidewall relative to the moving direction of the movable plate is al, and an inclination angle of each of the at least one second inner sidewall relative to the moving direction of the movable plate is (31.

In a preferred embodiment, each of the at least one water outlet further comprises a third inner sidewall and a fourth inner sidewall, each of the at least one insertion part is further comprises a third outer sidewall and a fourth outer sidewall, each of the third outer sidewalls abuts a corresponding one of the third inner sidewalls, and each of the fourth outer sidewalls abuts a corresponding one of the fourth inner sidewalls.

In a preferred embodiment, a positioning block is disposed between the movable plate and a base of a corresponding one of the at least one insertion part, the water outflow part comprises a water outflow surface cover, the at least one water outlet is located on the water outflow surface cover, and when the movable plate is in the first position, the positioning block abuts a rear surface of the water outflow surface cover.

In a preferred embodiment, a positioning block is disposed between the movable plate and a base of a corresponding one of the at least one insertion, each of the positioning blocks is provided with an extension portion, and each of the extension portions extends out of the other outer sidewalls of each of the at least one insertion part besides the first outer sidewall of each of the at least one insertion part.

In a preferred embodiment, a positioning block is disposed on a base of each of the at least one insertion part, and the positioning blocks enclose other parts of the base of each of the at least one insertion part besides the first outer sidewall of each of the least one insertion part.

In a preferred embodiment, the movable plate comprises at least one through outflow hole through which water flows out, and the at least one through outflow hole is connected to the at least one water outlet.

In a preferred embodiment, the shell further comprises a peripheral wall portion, an outer periphery of the water outflow part is sealed and fixed on an inner sidewall of the peripheral wall portion, and the movable plate and the driving mechanism are disposed in the peripheral wall portion.

In a preferred embodiment, the driving mechanism comprises a wheel body, the wheel body rotates due to water outflow, the wheel body is rotatably disposed in the shell, and the wheel body and the movable plate are rotatably connected.

In a preferred embodiment, the driving mechanism further comprises a rotary block, the rotary block is synchronously mounted and connected with the wheel body, an outer periphery of the rotary block is convexly provided with a driving block, the movable plate is provided with an annular part having a concave and convex rail on an end surface of the annular part, and the driving block abuts the concave and convex rail.

In a preferred embodiment, the movable plate is provided with a through hole, the lower periphery of the through hole extends downward to form the annular part, and the rotary block passes through the through hole of the movable plate.

The second technical scheme provided by the disclosure is as follows:

A water outflow device comprises a shell, a movable plate and a driving mechanism. The shell comprises a water outflow part, the water outflow part comprises at least one water outlet, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, the at least one insertion part is at least partially inserted into a corresponding one of the at least one water outlet, when the movable plate is located in the first position, a front end of the at least one insertion part is flush with or extends out of a lower port of the corresponding one of the at least one water outlet, when the movable plate is located in the second position, the front end of the at least one insertion part is retracted in the corresponding one of the at least one water outlet, and a water outflow angle of the water outflow part is different when the movable plate is in the first position and in the second position.

The third technical scheme provided by the disclosure is as follows:

A water outflow device comprises a shell, a movable plate and a driving mechanism. The shell comprises a water outflow part, the water outflow part comprises at least one water outlet, each of the at least one water outlet comprises a first inner sidewall and a second inner sidewall, the first inner sidewall and the second inner sidewall cooperate to form a trapezoidal structure with a lower end that is narrower than an upper end, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, the at least one insertion part comprises a first outer sidewall and a second outer wall sidewall, each of the at least one insertion part is at least partially inserted into a corresponding one of the at least one water outlet, and the first outer sidewall and the second outer sidewall cooperate to form a trapezoidal structure with a lower end that is narrower than an upper end.

The fourth technical scheme provided by the present disclosure is as follows:

A water outflow device comprises a shell, a movable plate and a driving mechanism. The shell comprises a water outflow part, the water outflow part comprises at least one water outlet, each of the at least one water outlet comprises a first inner sidewall, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, each of the at least one insertion part comprises a first outer sidewall, each of the at least one insertion part is at least partially inserted into a corresponding one of the at least one water outlet, when the movable plate is located in the first position, a water outflow angle formed by the water outflow part is outward, and when the movable plate is located in the second position, the water outflow angle formed by the water outflow part is at least one of inward or vertically downward.

The fifth technical scheme provided by the disclosure is as follows:

A water outflow device comprises a shell, a movable plate and a driving mechanism. The shell comprises a water outflow part, the water outflow part comprises at least one water outlet, each of the at least one water outlet comprises a first inner sidewall, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, each of the at least one insertion part comprises a first outer sidewall, each of the at least one insertion part is at least partially inserted into a corresponding one of the at least one water outlet, when the movable plate is located in the first position, a water outflow angle formed by the water outflow part is S1, when the movable plate is located in the second position, the water outflow angle formed by the water outflow part is S2, and the S1 and the S2 are different.

The beneficial effects of the present disclosure are as follows:

The insertion part always cooperates with the water outlet, and the movable plate moves repeated between the first position and the second position so that the water outflow is circulated from a first water outflow passage to a second water outflow passage. That is to say, the water outflow of the water outlet changes through the moving of the movable plate, and the repeatedly changing effluent constitutes a kind of spray.

The water outlet forms the first water outflow passage between the first outer sidewall and the first inner sidewall when the movable plate is in the first position, the water outlet forms a second water outflow passage when the movable plate is in the second position, the second water outflow passage includes a rear water outflow passage sandwiched between the first outer sidewall and the first inner sidewall and a front water outflow passage formed by the lower port of the water outlet and connected to the rear water outflow passage, which makes the water outflow of the first water outflow passage different from that of the second water outflow passage, and the repeatedly changing water outflow constitutes a kind of spray.

The front end of the insertion part is flush with or extends out the lower port of the water outlet when the movable plate is in the first position, and the front end of the insertion part is retracted in the water outlet when the movable plate is in the second position, which makes the water outflow angle of the movable plate different when the movable plate is in the first position and is in the second position. The repeatedly changing water outflow angle constitutes a kind of spray, and the repeated changing water outflow constitutes a kind of spray.

The first inner sidewall and the second inner sidewall of the water outlet cooperate to form a trapezoidal structure with a narrow lower end and a wide upper end. The first outer sidewall and the second outer sidewall of the insertion part of the movable plate cooperate to form a trapezoidal structure with a narrow lower end and a wide upper end, which makes the water outlet different when the movable plate is in the first position and the second position.

The driving mechanism is connected to the movable plate to drive the movable plate to move repeatedly between a first position and a second position along a direction of close to or away from the at least one water outlet. When the movable plate is located in the first position, the water outflow angle formed by the water outflow part is facing outward, when the movable plate is located in the second position, the water outflow angle formed by the water outflow part is facing inward or downward vertically. The effect of the spray is therefore unique.

DETAILED DESCRIPTION OF THE EMBODIMENTS

Figure 1:
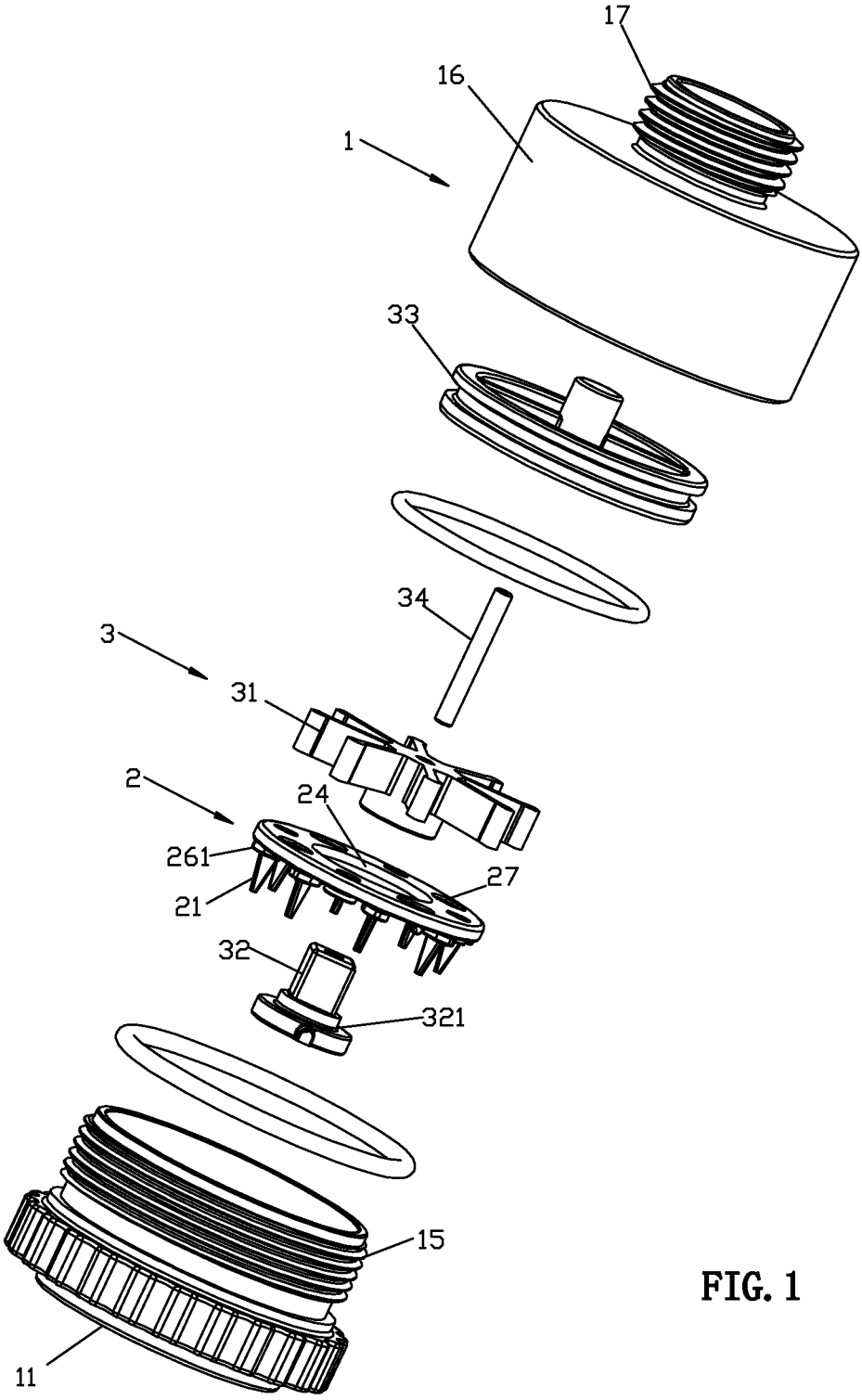
FIG. 1 illustrates an exploded perspective view of the water outflow device of a specific embodiment.
Figure 2:
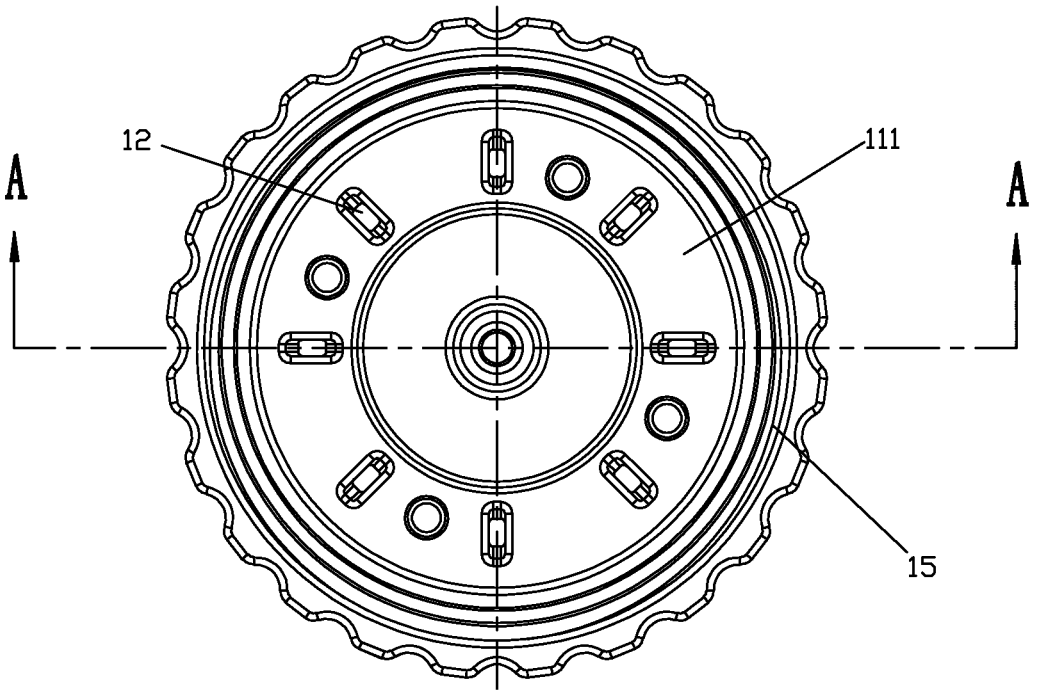
FIG. 2 illustrates a top view of the surface cover of the water outflow device of the specific embodiment.
Figure 3:
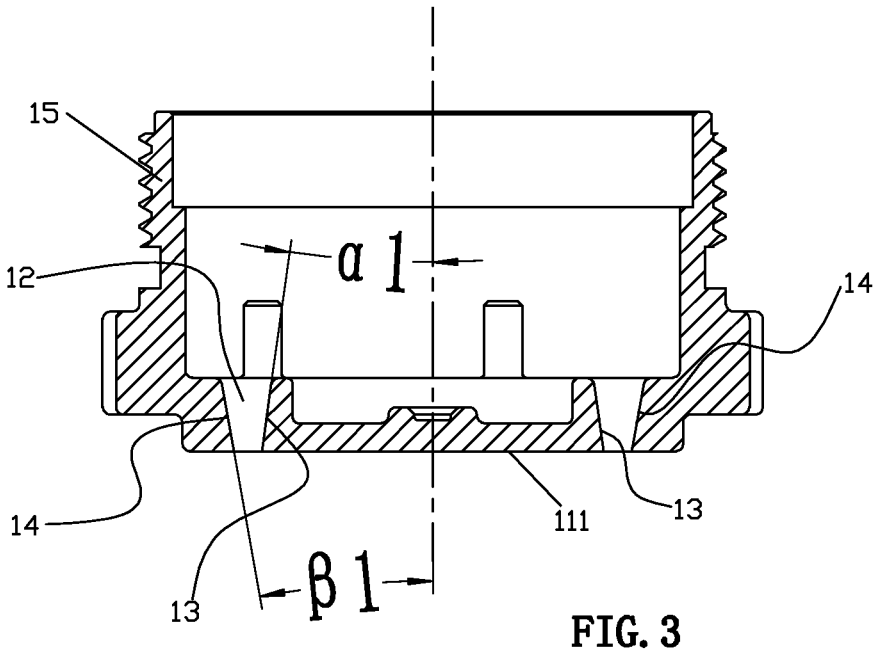
FIG. 3 illustrates a cross-sectional view taken along line A-A of FIG. 2
Figure 4:
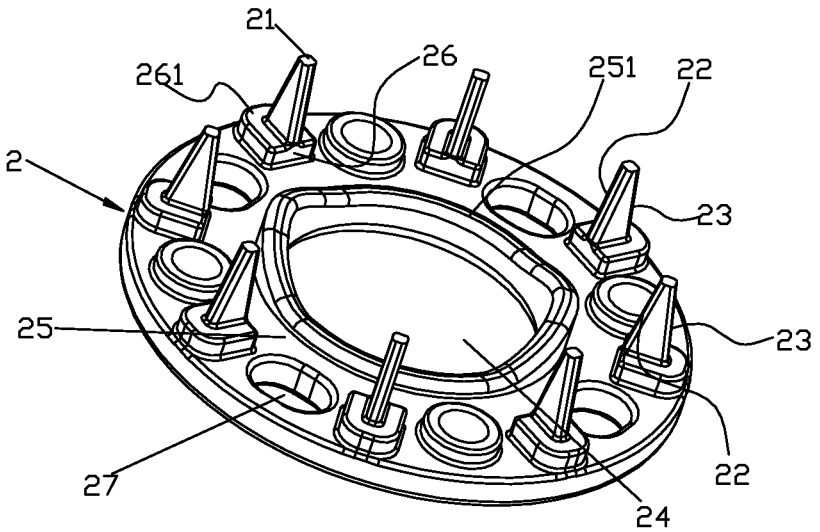
FIG. 4 illustrates a perspective view of the movable plate of the water outflow device of the specific embodiment.
Figure 5:
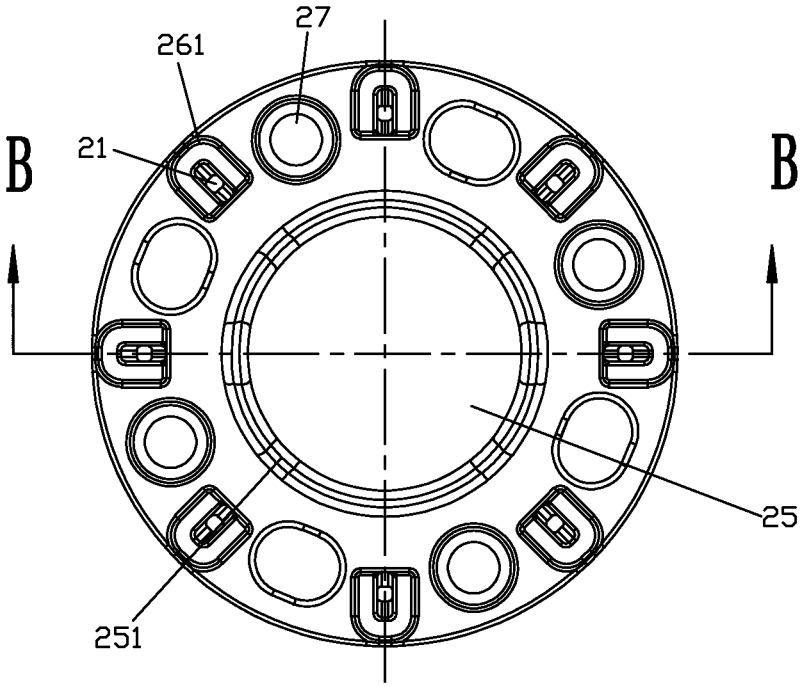
FIG. 5 illustrates a bottom view of the movable plate of the water outflow device of the specific embodiment.
Figure 6:
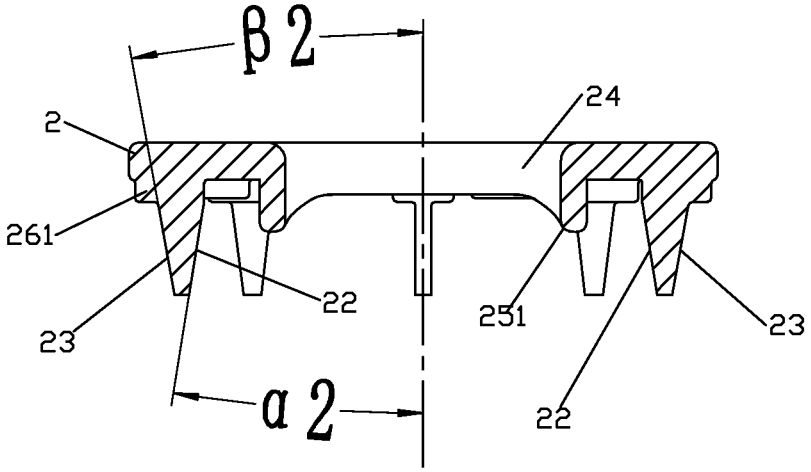
FIG. 6 illustrates a cross-sectional view taken along line B-B of FIG. 5.
Figure 7:
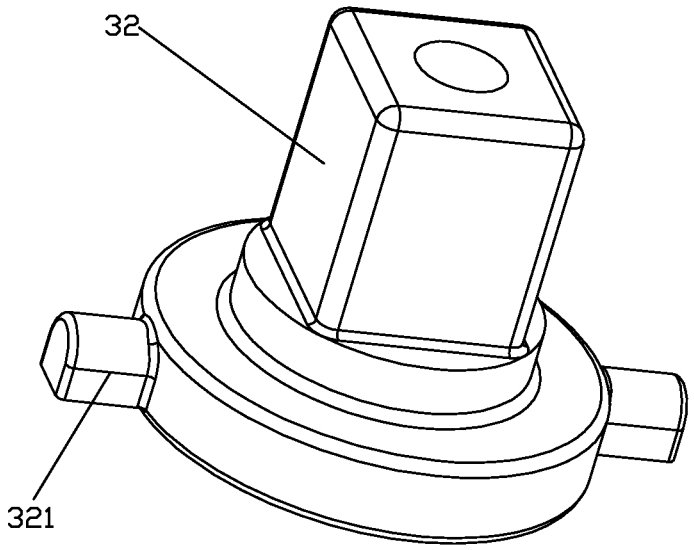
FIG. 7 illustrates a perspective view of the rotary block of the water outflow device of the specific embodiment.
Figure 8:
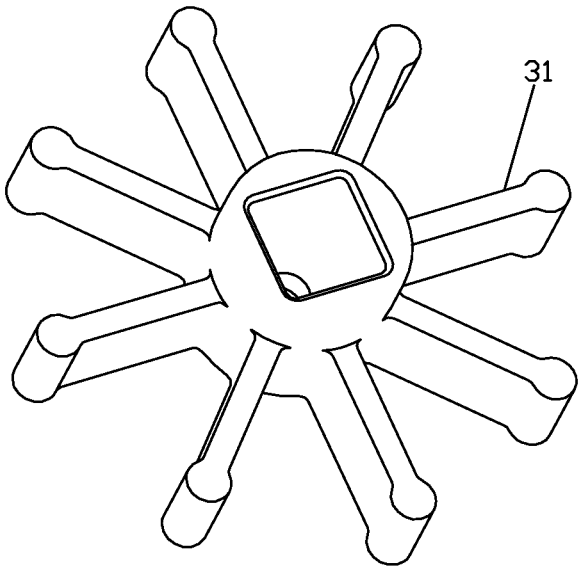
FIG. 8 illustrates a perspective view of the impeller of the water outflow device of this specific embodiment.
Figure 9:
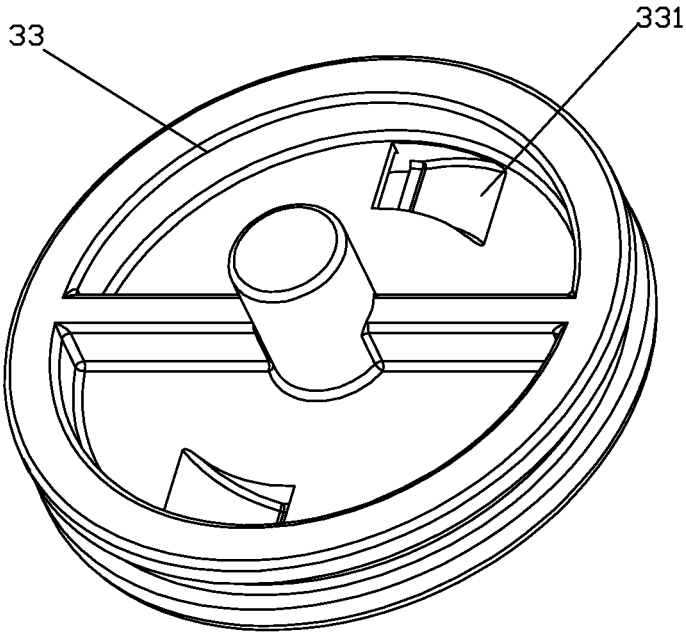
FIG. 9 illustrates a perspective view of the oblique water body of the water outflow device of the specific embodiment.
Figure 10:
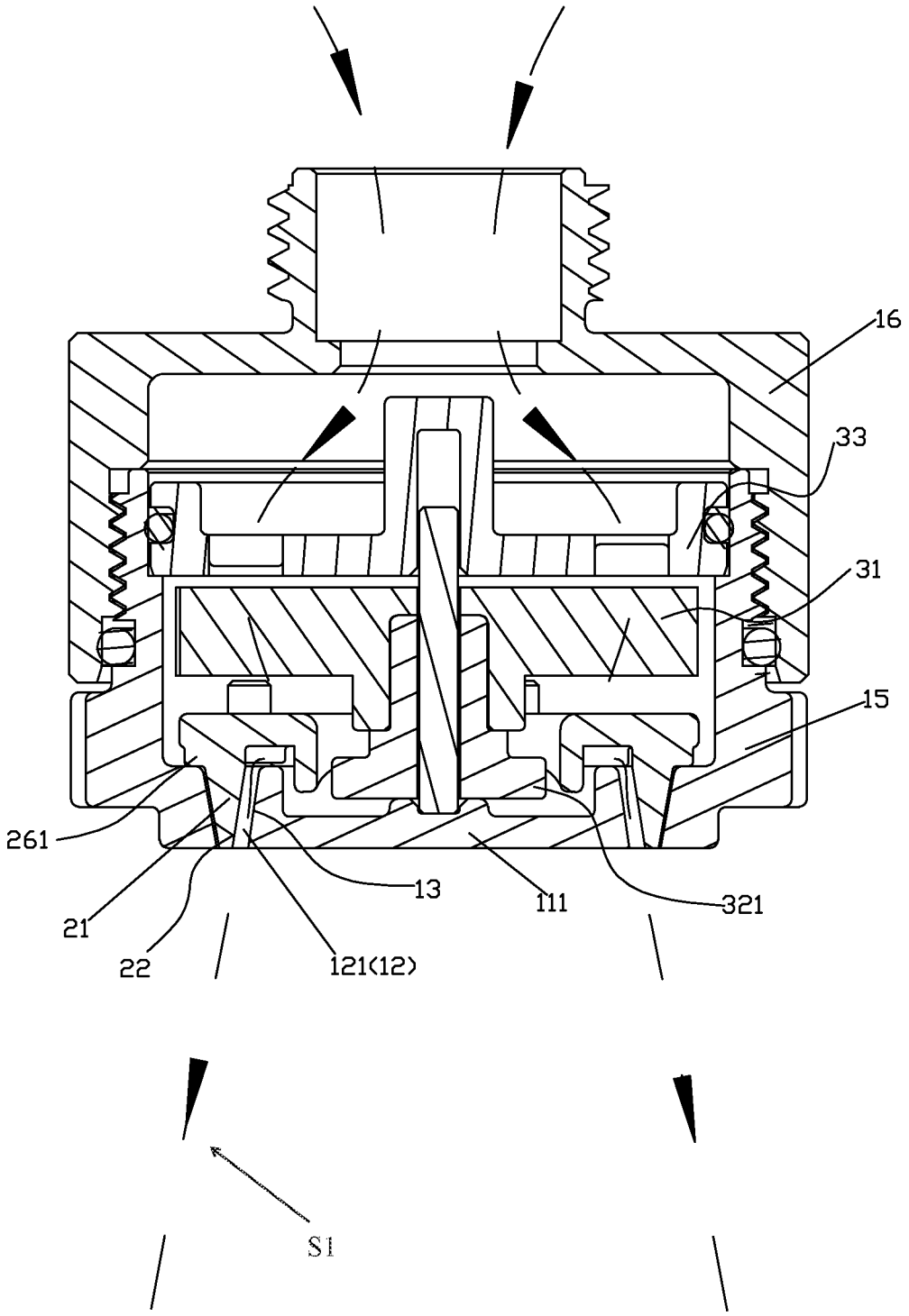
FIG. 10 illustrates a schematic view in which the movable plate of the water outflow device of the specific embodiment is in a first position and water flows out from the first water outflow passage, and a dashed line with arrows in FIG. 10 indicates the first water outflow passage.
Figure 11:
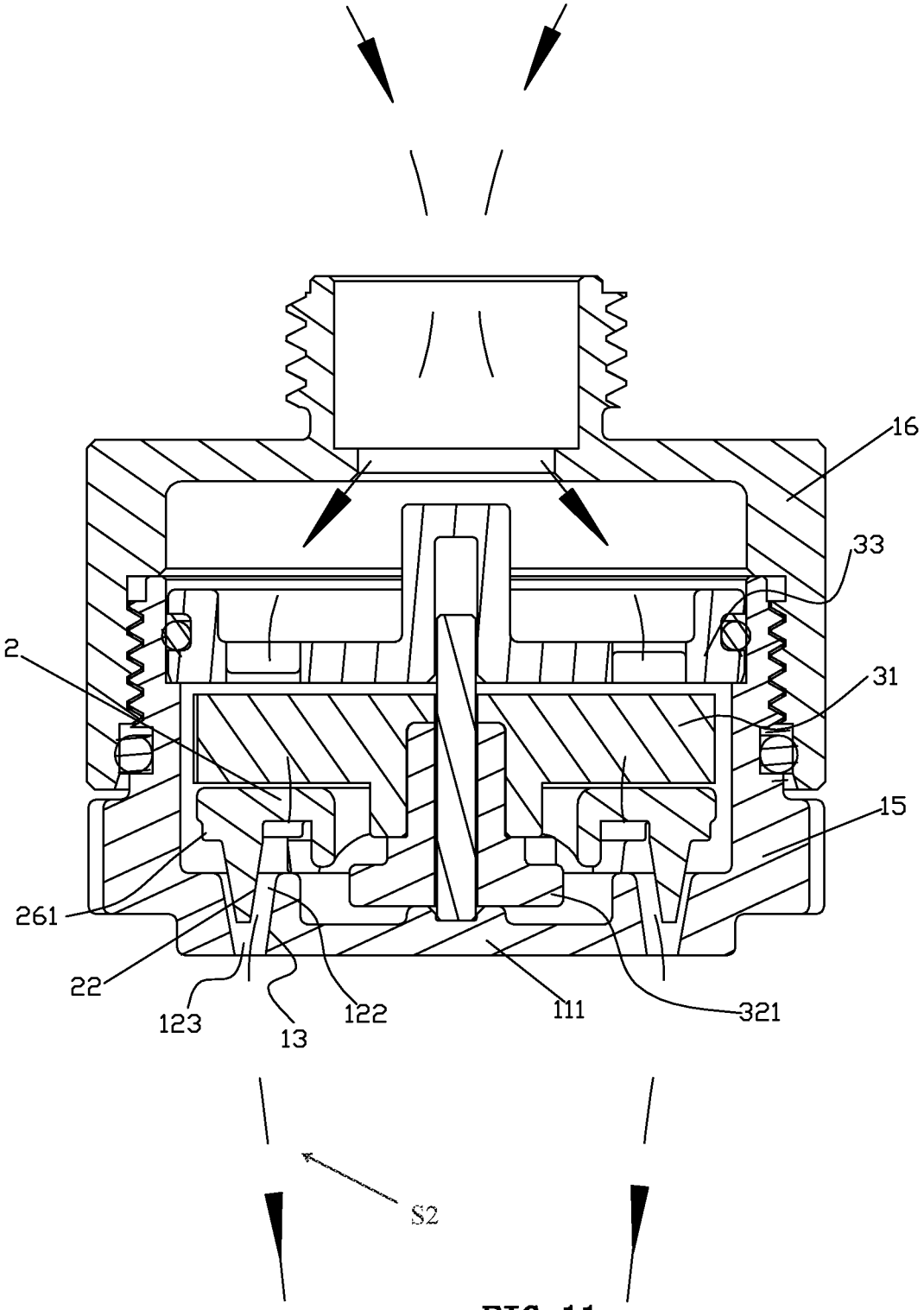
FIG. 11 illustrates a schematic view in which the movable plate of the water outflow device of the specific embodiment is in a second position and water flows out from the second water outflow passage, and a dashed line with arrows in FIG. 11 indicates the second water outflow passage.
Figure 12:
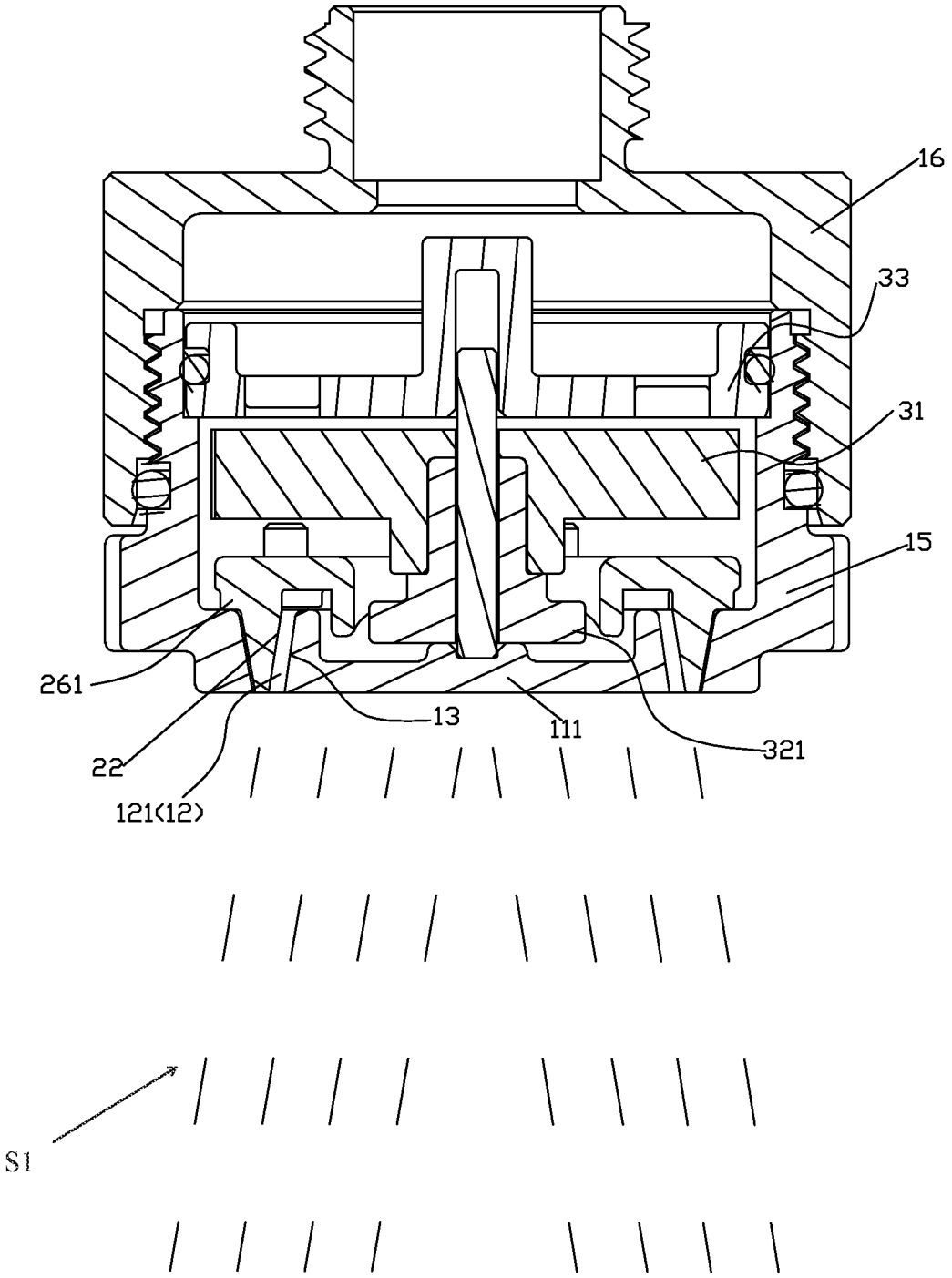
FIG. 12 illustrates a schematic view in which the movable plate of the water outflow device of the specific embodiment is in a first position and water flows out from the first water outflow passage, and a dotted line in FIG. 12 indicates the water outflow.
Figure 13:
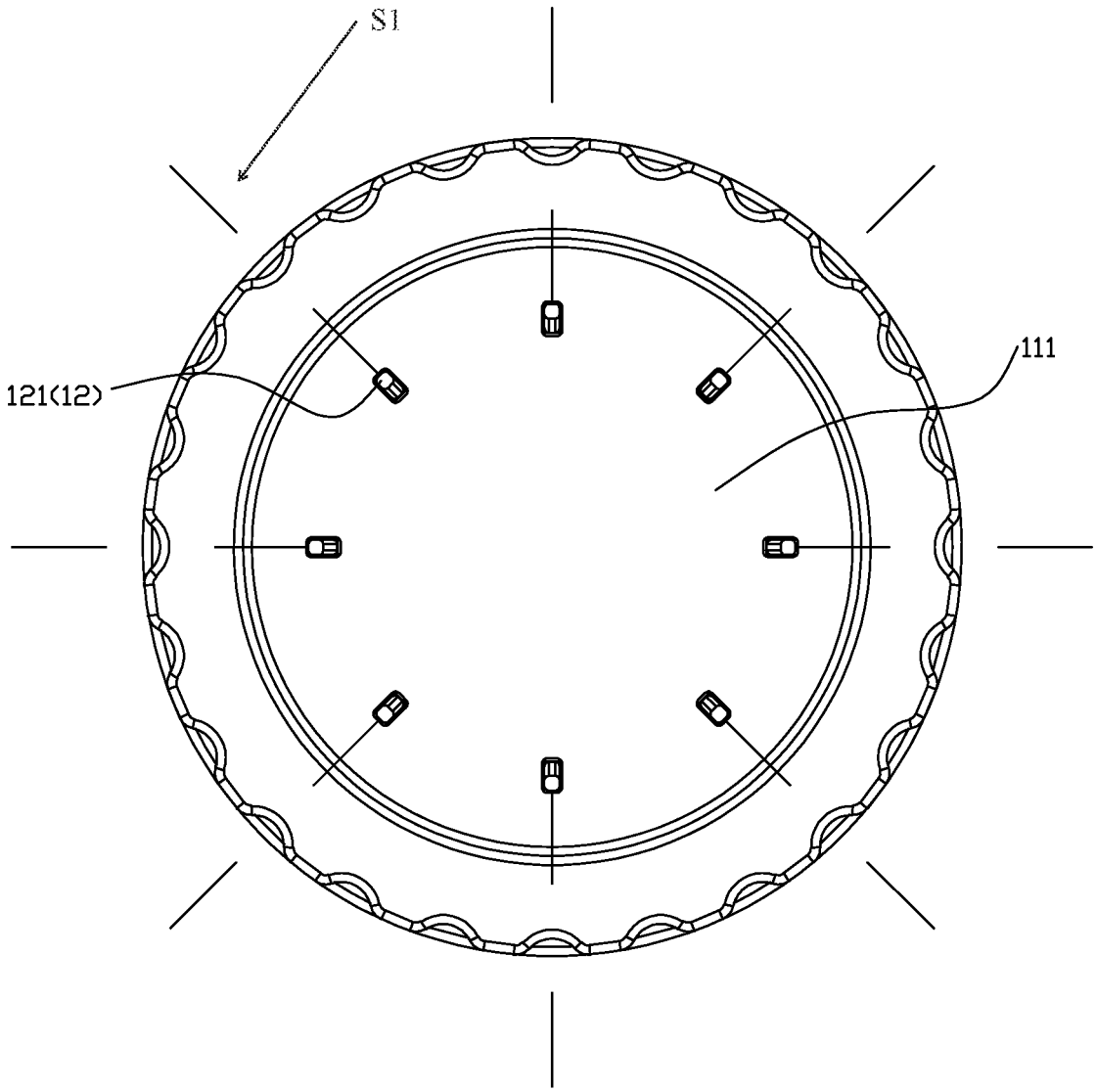
FIG. 13 illustrates a bottom schematic view of the water outflow of the water outflow device in FIG. 12.
Figure 14:
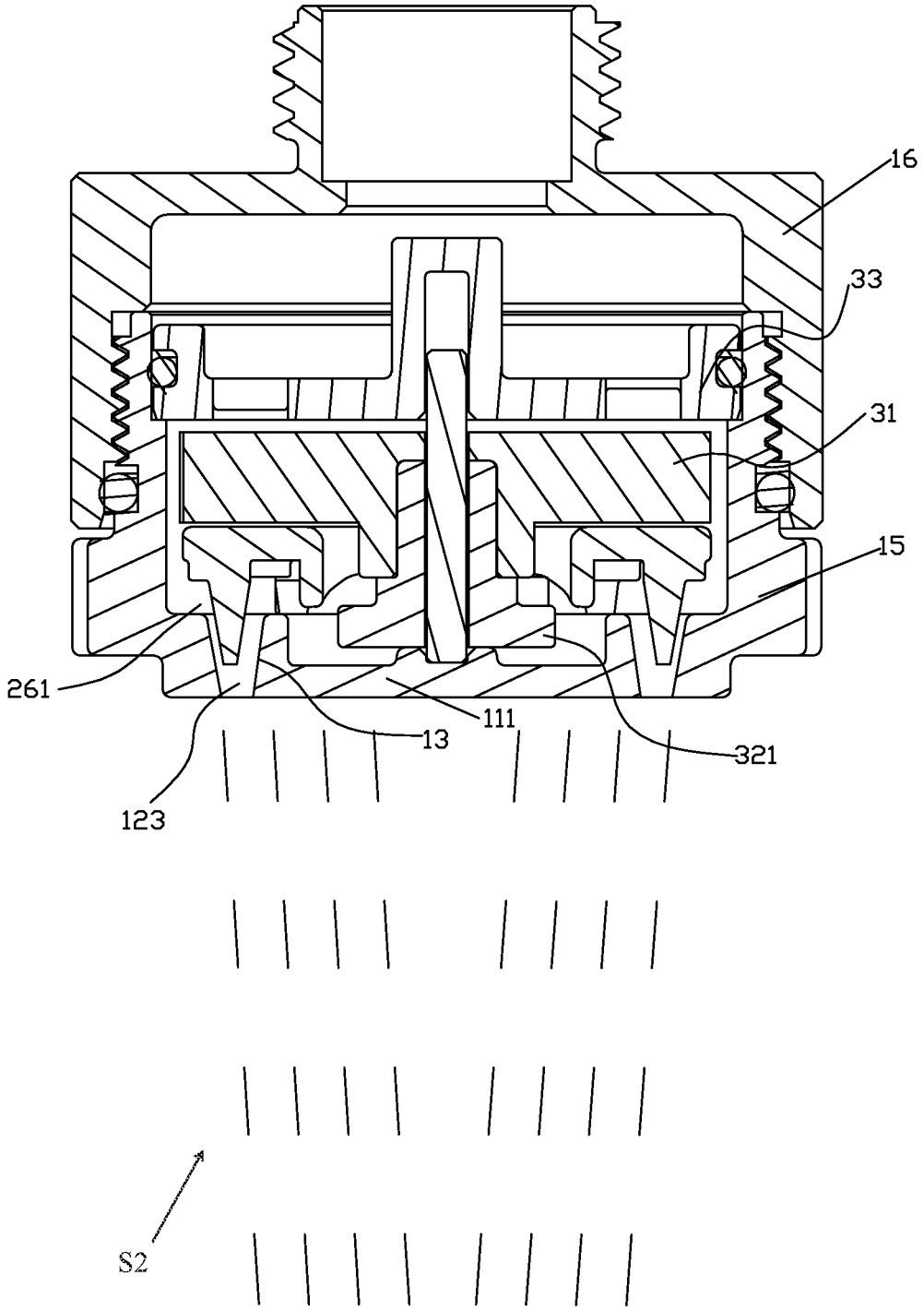
FIG. 14 illustrates a schematic view in which the movable plate of the water outflow device of the specific embodiment is in a second position and water flows out from the second water outflow passage, and a dotted line in FIG. 14 indicates the water outflow.
Figure 15:
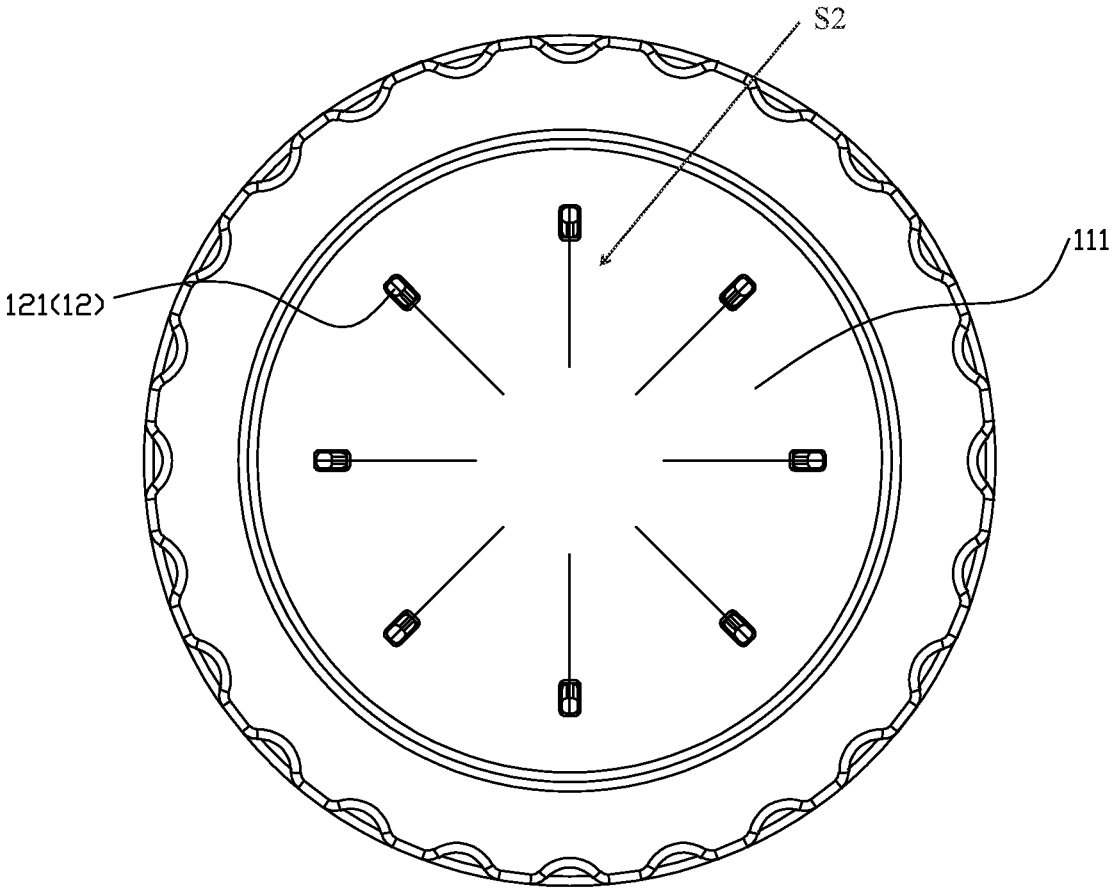
FIG. 15 illustrates a bottom schematic view of the water outflow of the water outflow device in FIG. 14.

Referring to FIGS. 1 to 15, a water outflow device comprises a shell 1, a movable plate 2, and a driving mechanism 3. The shell 1 is provided with a water outflow part 11. The water outflow part 11 comprises a plurality of water outlets 12, by way of example, arranged in an annular array at intervals. Each of the water outlets 12 comprises a first inner sidewall 13 and a second inner sidewall 14. The second inner sidewall 14 and the first inner sidewall 13 face each other, for example, the second inner sidewall 14 faces an inside of the water outflow part 11, and the first inner sidewall 13 faces an outside of the water outflow part 11. The driving mechanism 3 is connected to the movable plate 2 to drive the movable plate 2 to repeatedly move between a first position and a second position. The movable plate 2 is close to the water outlets 12 in the first position. The movable plate 2 is disposed away from the water outlets 12 in the second position, and a moving direction of the movable plate 2 is, for example, a direction moving up and down. The movable plate 2 is fixedly provided with a plurality of insertion parts 21, by way of example, arranged in an annular array at intervals. Each of the insertion parts 21 comprises a first outer sidewall 22 and a second outer sidewall 23, the second outer sidewall 23 and the first outer sidewall 22 are arranged back to back. Each of the plurality of insertion parts 21 is respectively inserted into each of the plurality of water outlets 12 one by one. When the movable plate 2 is located in a first position which is close to the water outlets 12, along the water flow direction, the lower end of the insertion parts 21 are co-planar with the lower port of the water outlets 12, each of the second inner sidewalls 14 abuts each of the second outer sidewalls 23, or there is only a small gap between each of the second inner sidewalls 14 and each of the second outer sidewalls 23. In each of the water outlets 12, a first water outflow passage 121 is formed between each of the first outer sidewalls 22 and each of the first inner sidewalls 13. The movable plate 2 is located in a second position, which is away from the water outlets 12. The lower end of the insertion parts 21 are retracted in the water outlets 12, a second water outflow passage is formed in each of the water outlets 12, each of the second water outflow passages comprises a rear water outflow passage 122 formed between each of the first outer sidewalls 22 and each of the first inner sidewalls 13, a front water outflow passage 123 is formed by the lower port of each of the water outlets 12, and each of the front water outflow passages 123 is connected to each of the rear water outflow passages 122. When the movable plate 2 is located in the first position which is close to the water outlets 12, and a water outflow from the water outlets 12 forms a first water outflow angle, as illustrated in FIGS. 10, 12 and 13, the first water outflow angle S1 is outward, and the water flow expands outwardly. When the movable plate 2 is located in the second position which is away from the water outlets 12, a water outflow from the water outlets 12 forms a second water outflow angle, as illustrated in FIGS. 11, 14 and 15, since the front water outflow passage 123 is not interfered with by the insertion parts 21, the second water outflow angle S2 is inward, and the water flow is contracted. Further, the second water outflow angle can be outward (while an angle of the second water outflow angle is different from an angle of the first water outflow angle) or can be vertically downward. The movable plate moves repeatedly, the water outflow from the water outlets changes repeatedly from the first water outflow angle S1 (outward) to the second water outflow angle S2 (inward), the outflow water finally forms a stream with its water outflow angle changing intermittently, and forms a spray pattern with a pulsed rhythm, which is a new water spray pattern. On the one hand, compared to the traditional massage water, it can bring a different shower massage experience, the impact frequency is slower, the massage feeling is more obvious for users, and the impact scope is larger. On the other hand, there are more choices according to the shape of the water outflows of massage water. At the same time, there can be different arrangements according to the water outflow part 11; it does not need to be only arranged as a circle, like the arrangement of the traditional massage water.

An inclination angle of the first inner sidewall 13 relative to a moving direction of the movable plate 2 is $\alpha 1$, for example, $\alpha 1$ is 5-15 degrees, and an inclination angle of the second inner sidewall 14 relative to the moving direction of the movable plate 2 is $\beta 1$, for example, $\beta 1$ is 5-15 degrees. When $\alpha 1<\beta 1$, the second water outflow angle S2 is inward, with the movable plate 2 moving repeatedly, the water outflow changes repeatedly from the first water outflow angle S1 (outward) to the second water outflow angle S2 (inward). When $\alpha 1=\beta 1$, the second water outflow angle S2 is downward, with the movable plate 2 moving repeatedly, the water outflow of the water outlet changes repeatedly from the first water outflow angle S1 (outward) to the second water outflow angle S2 (vertically downward). When $\alpha 1>\beta 1$, the second water outflow angle S2 is outward at the angle of $(\alpha 1-\beta 1)$, with the movable plate 2 moving repeatedly, the water outflow of the water outlet changes repeatedly from $\alpha 1$ angle (outward) to angle $(\alpha 1-\beta 1)$ (outward). Along the direction of the water outflow, the first inner sidewall 13 and the second inner sidewall 14 cooperate to form a symmetrical trapezoidal structure with a narrow lower end and a wide upper end. An inclination angle of the first outer sidewall 22 relative to the moving direction of the movable plate 2 is $\alpha 2$, and an inclination angle of the second outer sidewall 23 relative to the moving direction of the movable plate 2 is (32. The first outer sidewall 22 and the second outer sidewall 23 cooperate to form a symmetrical trapezoidal structure with a narrow lower end and a wide upper end along the water outflow direction. The first outer sidewall 22 and the first inner sidewall 13 are arranged in parallel at intervals. Moreover, wherein: $\alpha 1=\alpha 2$, $\beta 1=\beta 2$, further, they can be unequal according to different needs. With this structure, a water outflow angle of the first water outflow passage and a water outflow angle of the second water outflow passage can be precisely controlled, and interference on the movement of the movable plate 2 can be avoided. In the present specific embodiment: each of the water outlets 12 further comprises a third inner sidewall and a fourth inner sidewall, each of the insertion parts 21 is further provided with a third outer sidewall and a fourth outer sidewall. The third outer sidewalls abut the third inner sidewalls, and the fourth outer sidewalls abut the fourth inner sidewalls. In this specific embodiment, each of the water outlets 12 is provided with four inner sidewalls, and each of the insertion parts is provided with four outer sidewalls, but the instant disclosure is not limited to this embodiment. According to specific needs, each of the water outlets 12 may have only three or five or six inner sidewalls, and so on, and each of the insertion parts 21 may have only three or five or six outer sidewalls, and so on.

A positioning block 26 is disposed between the movable plate 2 and a base of each of the insertion parts 21 corresponding to the movable plate 2. Each of the positioning blocks 26 is provided with an extension portion 261, each of the insertion parts 21 is provided with a first outer sidewall 22 and other outer sidewalls, and each of the extension portions 261 extends out of the other outer sidewalls of each of the insertion parts 21. The water outflow part 11 comprises a water outflow surface cover 111, the water outlets 12 are located on the water outflow surface cover 111, and when the movable plate 2 is in the first position, the extension portions 261 abut a rear surface of the water outflow surface cover 111. On the one hand, the movable plate 2 can be located at the first position; on the other hand, each of the water outlets 12 is provided with the first inner sidewall 13 and the other inner sidewalls, the extension portions 261 can cover the cooperating position of the other outer sidewalls and the other inner sidewalls (such as gaps or intervals or abutted places), further avoiding the water flowing out from the gaps or the intervals or the abutted places between the insertion parts 21 and the water outlets 12.

In the specific embodiment, the movable plate 2 is provided with a through outflow hole 27.

The shell 1 comprises a peripheral wall portion, which comprises a lower peripheral wall 15 and an upper peripheral wall 16. The water outflow surface cover 111 extends upwardly to form the lower peripheral wall 15, and the water outflow surface cover 111 and the lower peripheral wall 15 jointly form the surface cover part. The upper peripheral wall 16 and the lower peripheral wall 15 are sealed and bonded together, for example, sealing and bonding through a thread connection and an annular sealing; an upper periphery of the upper peripheral wall 16 extends inwardly to form a annular wall, and the inner periphery of the annular wall extends upwardly to form a connection head 17 that can be connected to the water supply source.

The movable plate 2 and the driving mechanism 3 are disposed in the peripheral wall portion. The driving mechanism 3 comprises a wheel body 31 which can rotate due to the water outflow, a rotary block 32, an oblique water body 33 and a rotary shaft 34, and the wheel body 31 comprises an impeller. The oblique water body 33 is fixed in the peripheral wall portion, and the oblique water body 33 comprises two through oblique water holes 331. One end of the rotary shaft 34 is connected to the water outflow part 11, and the other end is connected to the oblique water body 33. The movable plate 2 is provided with a through hole 24. A lower periphery of the through hole 24 extends downwardly to form an annular part 25, and a lower end surface of the annular part 25 is provided with a concave and convex rail 251. An outer periphery of the rotary block 32 is convexly provided with a driving block 321. The rotary block 32 passes through the through hole 24 of the movable plate 2, and the concave and convex rail 251 abuts the driving block 321. By rotating the rotary block 32, the driving block 321 can be driven to move circumferentially to cooperate with the concave and convex rail 251, and the movable plate 2 can be driven to move up and down subsequently. The impeller is synchronously mounted on the rotary block 32. The impeller is located under the oblique water body 33, so that the water outflow from the oblique water hole can impact the impeller to drive the impeller to rotate. The rotary shaft 34 passes through the rotary block 32 and the impeller.

The above description is only a preferred embodiment of the present disclosure, and the scope of the present disclosure is not limited in this embodiment. That is, equivalent changes and modifications made in the scope of the disclosure and the specification contents should remain within the scope of the present disclosure.

What is claimed is:

1. A water outflow device, comprising:
a shell;
a movable plate; and
a driving mechanism, wherein:
the shell comprises a water outflow part,
the water outflow part comprises at least one water outlet,
each of the at least one water outlet comprises a first inner sidewall and a second inner sidewall,
the driving mechanism is connected to the movable plate to drive the movable plate to move repeatedly between a first position and a second position in a moving direction,
a distance between the movable plate and the at least one water outlet when the movable plate is in the first position is less than the distance between the movable plate and the at least one water outlet when the movable plate is in the second position,
the movable plate comprises at least one insertion part fixedly disposed on the movable plate,
each of the at least one insertion part comprises a first outer sidewall and a second outer sidewall,
each of the at least one insertion part is at least partially inserted into a corresponding one of the at least one water outlet,
the second inner sidewall of each of the at least one water outlet faces the first inner sidewall of each of the at least one water outlet,
the first inner sidewall and the second inner sidewall cooperate to form a first trapezoidal cross-section,
a lower end of the first trapezoidal cross-section is narrower than an upper end of the first trapezoidal cross-section,
the second outer sidewall of each of the at least one insertion part faces away from the first outer sidewall of each of the at least one insertion part,
the first outer sidewall and the second outer sidewall cooperate to form a second trapezoidal cross-section,
a lower end of the second trapezoidal cross-section is narrower than an upper end of the second trapezoidal cross-section,
when the movable plate is located in the first position, a first water outflow passage is formed in each of the at least one water outlet between the first outer sidewall of a corresponding one of the at least one insertion part and the first inner sidewall,
when the movable plate is located in the second position, a second water outflow passage is formed in each of the at least one water outlet,
each of the second water outflow passages comprises:
a rear water outflow passage formed between the first outer sidewall of the corresponding one of the at least one insertion part and the first inner sidewall, and
a front water outflow passage formed by a lower port of the water outlet, and
each of the front water outflow passages is connected to each of the rear water outflow passages.

2. The water outflow device according to claim 1, wherein the first outer sidewall is separated from and parallel to the first inner sidewall.

3. The water outflow device according to claim 1, wherein:
the first outer sidewall is separated from and parallel to the first inner sidewall, and
an inclination angle of the second outer sidewall relative to the moving direction of the movable plate is the same as an inclination angle of the second inner sidewall relative to the moving direction of the movable plate.

4. The water outflow device according to claim 1, wherein:
the first trapezoidal cross-section is a first symmetrical trapezoidal cross-section, and
the second trapezoidal cross-section is a second symmetrical trapezoidal cross-section.

5. The water outflow device according to claim 1, wherein:
each of the at least one water outlet further comprises a third inner sidewall and a fourth inner sidewall,
each of the at least one insertion part further comprises a third outer sidewall and a fourth outer sidewall,
each of the third outer sidewalls abuts a corresponding one of the third inner sidewalls, and
each of the fourth outer sidewalls abuts a corresponding one of the fourth inner sidewalls.

6. The water outflow device according to claim 1, wherein:
a positioning block is disposed between the movable plate and a base of a corresponding one of the at least one insertion part,
the water outflow part comprises a water outflow surface cover,
the at least one water outlet is located on the water outflow surface cover, and
when the movable plate is in the first position, the positioning block abuts a rear surface of the water outflow surface cover.

7. The water outflow device according to claim 1, wherein:
a positioning block is disposed between the movable plate and a base of a corresponding one of the at least one insertion part, the positioning block is provided with an extension portion, and the extension portion extends out of other outer sidewalls of each of the at least one insertion part besides the first outer sidewall of each of the at least one insertion part.

8. The water outflow device according to claim 1, wherein:

a positioning block is disposed on a base of each of the at least one insertion part, and the positioning block encloses other parts of the base of each of the at least one insertion part besides the first outer sidewall of each of the at least one insertion part.

9. The water outflow device according to claim 1, wherein:

the movable plate comprises at least one through outflow hole through which water flows out, and the at least one through outflow hole is connected to the at least one water outlet.

10. The water outflow device according to claim 1, wherein:

the shell further comprises a peripheral wall portion, an outer periphery of the water outflow part is sealed and fixed on an inner sidewall of the peripheral wall portion, and the movable plate and the driving mechanism are disposed in the peripheral wall portion.

11. The water outflow device according to claim 1, wherein:

the driving mechanism comprises a wheel body, the wheel body rotates due to water outflow, the wheel body is rotatably disposed in the shell, and the wheel body and the movable plate are rotatably connected.

12. The water outflow device according to claim 11, wherein:

the driving mechanism further comprises a rotary block, the rotary block is synchronously mounted and connected with the wheel body, an outer periphery of the rotary block is convexly provided with a driving block, the movable plate is provided with an annular part having a concave and convex rail on an end surface of the annular part, and the driving block abuts the concave and convex rail.

13. The water outflow device according to claim 12, wherein:

the movable plate is provided with a through hole, a lower periphery of the through hole extends downward to form the annular part, and the rotary block passes through the through hole of the movable plate.

14. A water outflow device, comprising:

a shell;

a movable plate; and a driving mechanism, wherein:

the shell comprises a water outflow part, the water outflow part comprises at least one water outlet, each of the at least one water outlet comprises a first inner sidewall and a second inner sidewall, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, each of the at least one insertion part comprises a first outer sidewall and a second outer sidewall, each of the at least one insertion part is at least partially inserted into a corresponding one of the at least one water outlet, the second inner sidewall of each of the at least one water outlet faces the first inner sidewall of each of the at least one water outlet, the first inner sidewall and the second inner sidewall cooperate to form a first trapezoidal cross-section, a lower end of the first trapezoidal cross-section is narrower than an upper end of the first trapezoidal cross-section, the second outer sidewall of each of the at least one insertion part faces away from the first outer sidewall of each of the at least one insertion part, the first outer sidewall and the second outer sidewall cooperate to form a second trapezoidal cross-section, a lower end of the second trapezoidal cross-section is narrower than an upper end of the second trapezoidal cross-section, when the movable plate is located in the first position, a water outflow angle formed by the water outflow part is outward, and when the movable plate is located in the second position, the water outflow angle formed by the water outflow part is at least one of inward or vertically downward.

15. A water outflow device, comprising:

a shell;

a movable plate; and a driving mechanism, wherein:

the shell comprises a water outflow part, the water outflow part comprises at least one water outlet, each of the at least one water outlet comprises a first inner sidewall and a second inner sidewall, the driving mechanism is connected to the movable plate to drive the movable plate to move repeatedly between a first position and a second position in a moving direction, a distance between the movable plate and the at least one water outlet when the movable plate is in the first position is less than the distance between the movable plate and the at least one water outlet when the movable plate is in the second position, the movable plate comprises at least one insertion part fixedly disposed on the movable plate, each of the at least one insertion part comprises a first outer sidewall and a second outer sidewall, each of the at least one insertion part is at least partially inserted into a corresponding one of the at least one water outlet, the second inner sidewall of each of the at least one water outlet faces the first inner sidewall of each of the at least one water outlet, the first inner sidewall and the second inner sidewall cooperate to form a first trapezoidal cross-section, a lower end of the first trapezoidal cross-section is narrower than an upper end of the first trapezoidal cross-section, the second outer sidewall of each of the at least one insertion part faces away from the first outer sidewall of each of the at least one insertion part, the first outer sidewall and the second outer sidewall cooperate to form a second trapezoidal cross-section, a lower end of the second trapezoidal cross-section that is narrower than an upper end of the second trapezoidal cross-section, when the movable plate is located in the first position, a water outflow angle formed by the water outflow part is S1, when the movable plate is located in the second position, the water outflow angle formed by the water outflow part is S2, and the S1 and the S2 are different.

* * * * *